US005889238A

United States Patent [19]

Ernecke et al.

[11] Patent Number: 5,889,238

[45] Date of Patent: Mar. 30, 1999

[54] DECELERATION TIME FOR AN ELEVATOR CAR

[75] Inventors: Christoph M. Ernecke; Gunter Blechschmidt; Peter L. Herkel, all of Berlin, Germany; Alberto Vecchiotti, Middletown, Conn.

[73] Assignee: Otis Elevator Company, Farmington, Conn.

[21] Appl. No.: 745,522

[22] Filed: Nov. 12, 1996

[51] Int. Cl.[6] ..... B66B 1/30

[52] U.S. Cl. ..... 187/291; 187/294

[58] Field of Search ..... 187/276, 289, 187/291, 293, 294

[56] References Cited

U.S. PATENT DOCUMENTS

| | | | |
|---|---|---|---|
| 4,427,095 | 1/1984 | Payne et al. | 187/29 R |
| 4,499,974 | 2/1985 | Nguyen et al. | 187/29 R |
| 4,750,592 | 6/1988 | Watt | 187/134 |
| 4,798,267 | 1/1989 | Foster et al. | 187/28 |
| 4,991,693 | 2/1991 | Stern et al. | 187/111 |
| 5,155,305 | 10/1992 | Horbruegger et al. | 187/119 |

FOREIGN PATENT DOCUMENTS

| | | |
|---|---|---|
| 0607646 | 1/1993 | European Pat. Off. . |
| 0382933 A2/3 | 4/1993 | European Pat. Off. . |
| 3173581 | 3/1991 | Japan . |

OTHER PUBLICATIONS

Copy of U.S. Patent Application Ser. No. 08/610,101 entitled "Elevator Leveling Adjustment" filed Feb. 29, 1996, Peter Herkel, et al.

*Primary Examiner*—Karen M. Young
*Assistant Examiner*—Gregory A Morse

[57] ABSTRACT

A method of adjusting an elevator speed comprising the steps of determining a desired creep period, determining an actual creep period, determining a difference between the desired creep period and the actual creep period, determining a deceleration time for minimizing the difference between the desired creep period and the actual creep period, and adjusting the elevator speed in response to the deceleration time.

4 Claims, 2 Drawing Sheets

DECELERATION TIME FOR AN ELEVATOR CAR

TECHNICAL FIELD

The present invention relates to elevator systems and, more particularly, elevator motion control.

BACKGROUND OF THE INVENTION

Modern elevator systems utilize sophisticated software and controllers which control most aspects of an elevator's operation. The controllers gather information from various sources in the elevator system and use such information to efficiently operate the elevator. Thus, elevator speed, elevator creep period, starting, stopping, floor positioning or leveling, and the like are all governed by the controller. Each of these functions are affected by variations in floor distances, friction, and stiction. Many older buildings, for example, have large variations in the distance between each landing. Additionally, friction and stiction varies from one elevator system to another, and also within each elevator system.

In a closed loop elevator system, the elevator functions mentioned above are generally monitored by using an encoder which measures motor shaft revolutions and translates the results into machine readable feedback signals delivered to the controller microprocessor. The controller uses these feedback signals to determine the present status of the elevator functions. If a deviation from a desired result is detected, then the controller attempts to provide appropriate compensation. For example, conventional elevator systems determine the time to begin deceleration during an elevator run by using the feedback signals supplied by the encoder. The encoder, however, introduces added expense and complexity into the elevator system. Accordingly, it is desirable to perform the above mentioned functions without the use of an encoder.

DISCLOSURE OF THE INVENTION

It is an object of the present invention to provide a method for improving the performance of an elevator system.

According to the present invention, a method of adjusting an elevator speed comprising the steps of: determining a desired creep period; determining an actual creep period; determining a difference between the desired creep period and the actual creep period; determining a deceleration time for minimizing the difference between the desired creep period and the actual creep period; and adjusting the elevator speed in response to the deceleration time.

BEST MODE FOR CARRYING OUT THE INVENTION

Figure 1:
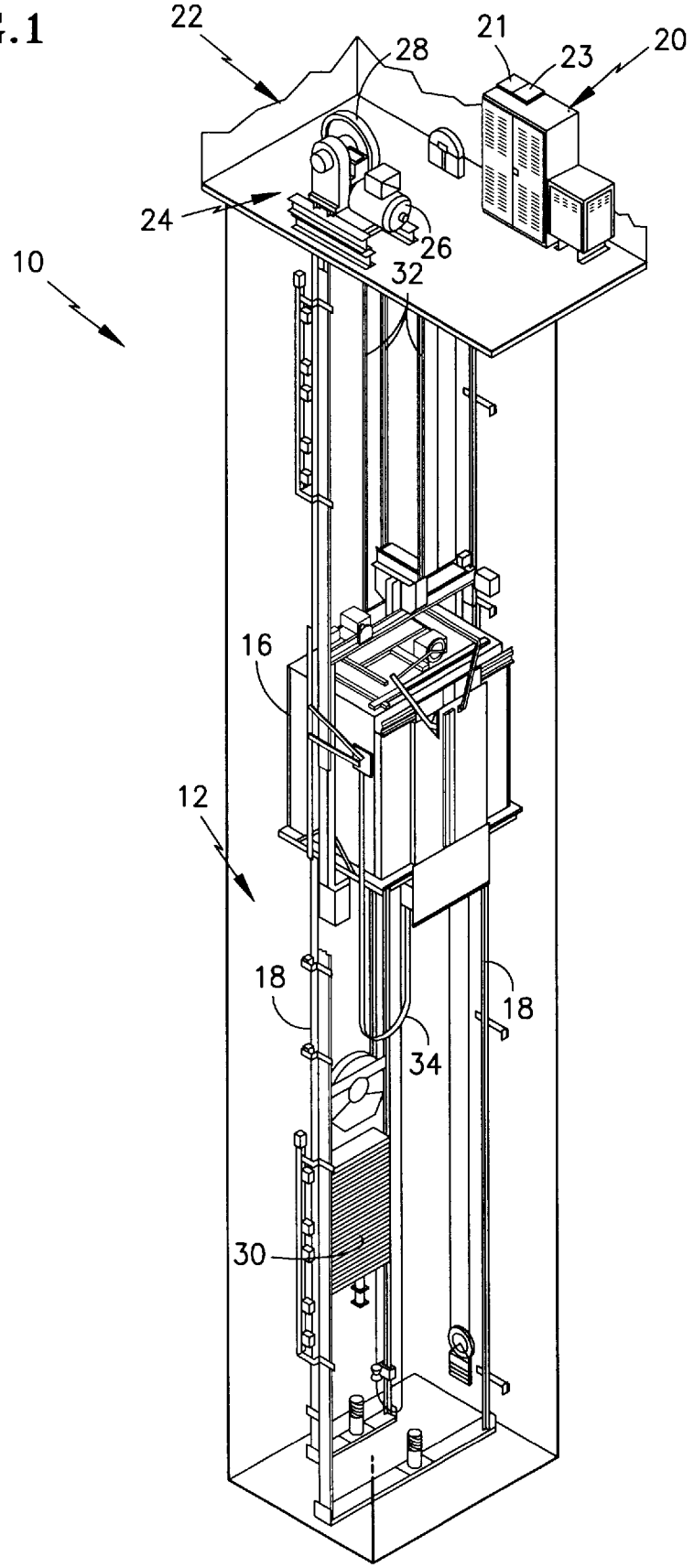
FIG. 1 is a perspective view of a elevator system employing a preferred embodiment of the present invention.

Referring to FIG. 1, an elevator system 10 employing a preferred embodiment of the present invention is shown. The elevator system 10 is disposed in a building having a plurality of floors. The building includes a hoistway 12 with a plurality of landings 14 that correspond to the plurality of floors. An elevator car 16 is disposed in the hoistway 12 such that the elevator car 16 may travel along the elevator guide rails 18 disposed vertically in the hoistway 12.

An elevator controller 20, disposed in a machine room 22, monitors and provides system control of the elevator system 10. The elevator controller 20 provides control signals to a motive apparatus 24 for controlling the movements of the elevator car 16 within the hoistway 12 as is explained herein below. The controller 20 includes a processor 21 and a memory 23. In one embodiment, the processor 21 is a commercially available microcontroller such as an Intel 80C196 and the memory 23 is a commercially available memory such as a NEC$\mu$PD43256AGU-85L (32K×8 bit static CMOS RAM). The processor 21 executes commands which are stored in the memory 23. One such set of commands enables the controller 20 to control the operation of an elevator drive in the controller 20 and thus the speed of a motor 26.

The motive apparatus 24 provides a means to move the elevator car 16 in the hoistway 12 and is responsive to the controller 20 such that the elevator car moves in the hoistway at a dictated speed according to the control signals. In one embodiment the motive apparatus 24 includes the drive, the motor 26, a drive sheave 28, a counterweight 30 and hoist ropes 32.

The motor 26 is drivenly associated with the drive sheave 28 such that a rotational output of the motor 26 is transferred to the drive sheave 28. The rotational output of the motor 26 is transmitted to the elevator car 16 by the hoist ropes 32 guided around the drive sheave 28; the elevator car 16 being at one end of the hoist ropes 32 and the counterweight 30 at the other. A traveling cable 34 is used to provide an electrical connection between the elevator controller 20 and electrical equipment in the elevator car 16. The drive is electrically connected to the motor 26 such that the drive dictates the motor speed in response to the control signal as is explained below. Of course, it should be realized that the present invention can be used in conjunction with other elevator systems including hydraulic and linear motor systems, among others.

Figure 2:
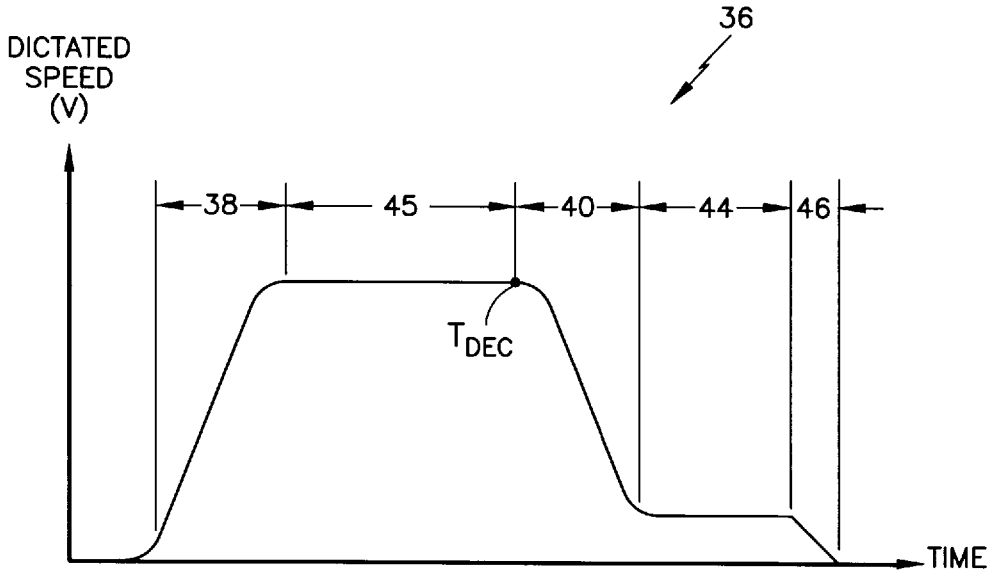
FIG. 2 is a diagram of an elevator car speed profile.

Referring to FIG. 2, the controller 20 controls the motive apparatus 24 by generating a profile 36 which is governed by parameters which include, among others, an acceleration and deceleration, a constant speed, a creep speed, a creep period, a jerk, a floor distance and a deceleration time.

The elevator car's speed increases at the dictated acceleration in an acceleration region 38 and decreases at the dictated deceleration in a deceleration region 40. In one embodiment, a value for the dictated acceleration and a value for the dictated deceleration are the same. The elevator car travels at a constant speed during the constant speed region 45. The elevator car travels at a creep speed in a creep speed region 44. The elevator car decelerates to a stop in a ramp down region 46.

The deceleration time $T_{dec}$ indicates the time that the motor apparatus begins its deceleration so that the elevator car may stop at a landing. In one embodiment, the deceleration time $T_{dec}$ is measured from the time the elevator car leaves a previous door zone. Thus, a deceleration time $T_{dec}$ of five seconds represents, for example, that the elevator car begins its deceleration five seconds after leaving the previous door zone. If the elevator car begins its deceleration too early then a long creep period occurs. The creep period is the length of time that the elevator car travels at the creep speed. Long creep periods increase the total travel time and, thus, are undesirable. Accordingly, short creep periods are preferred. In one embodiment, a creep period of 1.6 seconds is implemented by the present invention. The present invention, as described below, maintains a short creep period, without the need for an encoder, even in buildings with varied floors distances.

Each controller is calibrated so that a proper deceleration time is attained for the particular building in which the controller resides as is described herein below.

The constant speed in the constant speed region 45 for a floor to floor run is determined as the minimum of $v_{ftf}$ and $v_{nom}$ where $v_{nom}$ is a contract speed and $V_{ftf}$ is determined according to the following equation.

$$v_{ftf} = -\frac{1}{2} \cdot a_{des} \cdot \left( \frac{a_{des}}{j} + t_{const_nom} \right) + \sqrt{\left( \frac{1}{2} a_{des} \cdot \left( \frac{a_{des}}{j} + t_{const_nom} \right) \right)^2 + a_{des} \cdot (s_{fdist} - v_{creep} \cdot t_{creep})}$$

wherein, $V_{ftf}$ is a maximum constant speed of the elevator for a particular floor to floor distance;

$a_{des}$ is the desired acceleration / deceleration;

j is the jerk;

$s_{fdist}$ is the floor distance between door zones;

$t_{const_nom}$ is the constant speed period;

$t_{creep}$ is the desired creep period; and $v_{creep}$ is the desired creep speed.

The constant speed is determined for each floor-to-floor run and for the multi-floor runs. For a multiple floor run the constant speed is assumed to be $v_{nom}$. In one embodiment, the constant speed is the same for all multi-floor runs.

A theoretical deceleration time for multiple floor runs ($t_{mdec}$) is determined according to the following equations:

$$a_{mdec} = \begin{cases} \sqrt{j \cdot (v_{nom} - v_{creep})} & \rightarrow j \cdot (v_{nom} - v_{creep}) < a_{des}^2 \\ a_{des} & \rightarrow \text{"otherwise"} \end{cases}$$

$$s_{mdecdist} = \frac{1}{2} \cdot \frac{(v_{nom}^2 - v_{creep}^2)}{a_{mdec}} + \frac{a_{mdec} \cdot (v_{nom} + v_{creep})}{j} + v_{creep} \cdot t_{creep} + \frac{1}{2} \cdot v_{creep} \cdot t_{ramp_dn}$$

$$T_{mdec} = \frac{(s_{fdist} - s_{mdecdist})}{v_{nom}}$$

wherein, $T_{mdec}$ is the deceleration time as measured from the last door zone for a multiple floor run;

$s_{fdist}$ is the floor distance between door zones;

$s_{mdecdist}$ is a total travel distance during the deceleration period, the creep period and the ramp down period;

$v_{nom}$ is the constant speed of the elevator;

$v_{creep}$ is the desired creep speed of the elevator;

$a_{mdec}$ is the dictated acceleration/deceleration of the elevator for a multiple floor run;

$a_{des}$ is the desired acceleration/deceleration;

j is the desired jerk;

$t_{creep}$ is the creep period; and $t_{ramp_dn}$ is the ramp down period

A theoretical deceleration time for floor to floor runs ($t_{fdec}$) is determined according to the following equations:

$$a_{ftf} = \begin{cases} \sqrt{j \cdot v_{ftf}} & \rightarrow v_{ftf} < \frac{a_{des}^2}{j} \\ a_{des} & \rightarrow \text{"otherwise"} \end{cases}$$

$$s_{fa0} = \frac{v_{ftf} \cdot a_{ftf}}{j} - \frac{12 a_{ftf}^3}{j^2} + \frac{1}{2} \cdot \left( \frac{v_{ftf}^2}{a_{ftf}} - \frac{a_{ftf} \cdot v_{ftf}}{j} \right)$$

$$s_{fdecdist} = \frac{1}{2} \frac{(v_{ftf}^2 - v_{creep}^2)}{a_{ftf}} + \frac{a_{ftf} \cdot (v_{ftf} \cdot v_{ftf})}{j} + v_{creep} \cdot t_{creep} + \frac{1}{2} \cdot v_{creep} \cdot t_{ramp_dn}$$

$$t_{fa0} = \frac{v_{ftf}}{a_{ftf}} + \frac{a_{ftf}}{j}$$

$$T_{fdec} = \frac{(s_{fdist} - s_{fa0} - s_{fdecdist})}{v_{ftf}} + t_{fa0}$$

wherein, $T_{fdec}$ is the deceleration time as measured from the last door zone for a floor to floor run;

$s_{fdist}$ is the floor distance between door zones;

$s_{fdecdist}$ is a total travel distance during the deceleration period, the creek period and the ramp down period;

$s_{fa0}$ is the distance traveled by the elevator during the acceleration period;

$v_{ftf}$ is the constant speed of the elevator for a floor to floor run;

$v_{creep}$ is the dictated creep speed of the elevator;

$a_{ftf}$ is the desired acceleration/deceleration rate of the elevator for a floor to floor run;

$a_{des}$ is the desired acceleration/deceleration;

j is the jerk;

$t_{creep}$ is the desired creep period;

$t_{ramp_dn}$ is the ramp down period;

$t_{const_nom}$ is the constant speed period;

$t_{fa0}$ is the deceleration period.

Once the theoretical deceleration time, $T_{mdec}$ for multiple floor runs or $T_{fdec}$ for floor to floor runs, for each run has been determined, a calibration run is performed for each floor-to floor run and each multi-floor run so that it can be determined whether the theoretical deceleration time produces an acceptable creep period. Accordingly, an actual creep period produced during the calibration run is compared to the desired creep period. The difference between the actual creep period and the desired creep period is the excess creep period. The excess creep period is minimized by the present invention by determining a deceleration time compensation $\Delta_{Tdec}$ which provides compensation for the friction and stiction inherent in the elevator system. The deceleration time $t_{dec}$ is determined in accordance with the following equation.

For a floor to floor run:

$$T_{dec} = T_{fdec} + \Delta_{\mathrm{Tdec}}$$

$$\Delta_{Tdec} = \frac{(t_{actual_creep} - t_{creep}) \cdot v_{creep}}{v_{ftf}}$$

wherein, $t_{creep}$ is the desired creep period of the elevator;

$t_{actual_creep}$ is the actual creep period of the elevator;

$v_{creep}$ is the creep speed of the elevator; and $v_{ftf}$ is the constant speed for a floor to floor run.

For a multiple floor run:

$$T_{dec} = T_{mdec} + \Delta_{\mathrm{Tdec}}.$$

$$\Delta_{Tdec} = \frac{(t_{actual_creep} - t_{creep}) \cdot v_{creep}}{v_{nom}}$$

wherein, $t_{creep}$ is the desired creep period of the elevator;

$t_{actual_creep}$ is the actual creep period of the elevator;

$v_{creep}$ is the creep speed of the elevator; and $v_{nom}$ is the constant speed for a multiple floor run.

The deceleration time compensation $\Delta_{Tdec}$ is determined for each floor-to-floor run and each multi-floor run and stored in a look-up table for use during normal runs. In one embodiment, each deceleration time compensation $\Delta_{Tdec}$ is determined for a first and second direction run. During a normal run, the controller uses the look-up table in order to determine the appropriate deceleration time compensation $\Delta_{Tdec}$ for the particular run. For example, if the elevator car is at a first floor lobby and a call at the fifth floor is assigned to the elevator car, the controller chooses the deceleration time compensation for a multi-floor run in an up direction. If, for example, the elevator car is at a third floor and a call at the second floor is assigned to the elevator car, the controller chooses the deceleration time compensation for a floor-to-floor run between the second and third floors in a down direction.

Thus, the present invention provides the advantage of determining a deceleration time which results in a small travel time without the need for an encoder or other feedback device.

Various changes to the above description may be made without departing from the spirit and scope of the present invention as would be obvious to one of ordinary skill in the art of the present invention.

What is claimed is:

1. A method of determining the point in time $T_{dec}$ for adjusting an elevator speed so as to decelerate to a landing, comprising the steps of:

(a) determining a desired creep period $t_{creep}$;

(b) determining an actual creep period $t_{actual_creep}$;

(c) determining a difference between the desired creep period and the actual creep period;

(d) determining a deceleration point in time $T_{dec}$ during an elevator run to begin deceleration which will minimize the difference between the desired creep period and the actual creep period; and (e) adjusting the elevator speed to begin deceleration in response to reaching said deceleration point in time $T_{dec}$.

2. A method of adjusting an elevator speed as recited in claim 1 wherein said step (d) comprises the steps of:

determining a theoretical deceleration time $T_{fdec}$ or $T_{mdec}$;

determining a deceleration time compensation $\Delta_{Tdec}$; and determining the deceleration time $T_{dec}$ as the sum of the theoretical deceleration time and the deceleration time compensation.

3. A method of adjusting an elevator speed as recited in claim 1 wherein the deceleration time is determined for a floor to floor run in accordance with the following:

$$T_{dec} = T_{fdec} + \Delta_{\mathrm{Tdec}}$$

$$\Delta_{Tdec} = \frac{(t_{actual_creep} - t_{creep}) \cdot v_{creep}}{v_{ftf}}$$

wherein, $T_{dec}$ is the deceleration time;

$T_{fdec}$ is a theoretical deceleration time for a floor to floor run;

$t_{creep}$ is the desired creep period;

$t_{actual_creep}$ is the actual creep period;

$v_{creep}$ is a creep speed; and $v_{ftf}$ is a constant speed for a floor to floor run.

4. A method of adjusting an elevator speed as recited in claim 1 wherein the deceleration time is determined for a multi-floor run in accordance with the following:

$$T_{dec} = T_{mdec} + \Delta_{\mathrm{Tdec}}$$

$$\Delta_{Tdec} = \frac{(t_{actual_creep} - t_{creep}) \cdot v_{creep}}{v_{nom}}$$

wherein, $T_{dec}$ is the deceleration time;

$T_{mdec}$ is a theoretical deceleration time for a multi-floor run;

$t_{creep}$ is the desired creep period;

$t_{actual_creep}$ is the actual creep period;

$v_{creep}$ is a creep speed; and $v_{nom}$ is a constant speed for a multi-floor run.

* * * * *